US010674834B2

(12) United States Patent
Sack et al.

(10) Patent No.: US 10,674,834 B2
(45) Date of Patent: Jun. 9, 2020

(54) PLAY YARD ASSEMBLY

(71) Applicant: Wonderland Nurserygoods Company Limited, N.T. (HK)

(72) Inventors: Daniel A. Sack, Pottstown, PA (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 544 days.

(21) Appl. No.: 15/071,211

(22) Filed: Mar. 16, 2016

(65) Prior Publication Data

US 2016/0270556 A1 Sep. 22, 2016

Related U.S. Application Data

(60) Provisional application No. 62/176,892, filed on Mar. 16, 2015.

(51) Int. Cl.

| | |
|---|---|
| ***A47D 9/00*** | (2006.01) |
| ***A47D 5/00*** | (2006.01) |
| ***A47D 13/06*** | (2006.01) |

(52) U.S. Cl.

CPC ..... *A47D 9/00* (2013.01); *A47D 5/00* (2013.01); *A47D 13/06* (2013.01)

(58) Field of Classification Search

CPC . A47D 9/00; A47D 5/00; A47D 13/00; A47D 13/06; A47D 13/061; A47D 13/063; A47D 13/065; A47D 13/068; A47D 13/10; A47D 13/107; A47D 15/00; A47D 15/005; A47D 15/008; A47D 7/00; A47D 7/04; A47D 7/002; A47D 7/005; A47D 7/007; A47D 7/01; A47D 7/02; A47D 7/03; A63H 33/006

See application file for complete search history.

(56) References Cited

U.S. PATENT DOCUMENTS

| | | | | |
|---|---|---|---|---|
| 2012/0204347 | A1* | 8/2012 | Li | A47D 7/00 5/93.1 |
| 2012/0235103 | A1* | 9/2012 | Greger | A47D 9/00 256/25 |
| 2013/0119333 | A1* | 5/2013 | Gillett | A47D 13/00 256/25 |
| 2013/0326808 | A1* | 12/2013 | Saint | A47D 5/00 5/93.1 |
| 2015/0047122 | A1 | 2/2015 | Ingram | |

FOREIGN PATENT DOCUMENTS

| | | | |
|---|---|---|---|
| CN | 102631103 | A | 8/2012 |
| CN | 103110301 | A | 5/2013 |
| CN | 104367038 | A | 2/2015 |
| DE | 10 2011 109 874 | A1 | 3/2012 |
| DE | 10 2012 016 920 | A1 | 2/2013 |
| EP | 2 837 309 | A1 | 2/2015 |

* cited by examiner

*Primary Examiner* — Eric J Kurilla
*Assistant Examiner* — Amanda L Bailey
(74) *Attorney, Agent, or Firm* — Winston Hsu

(57) ABSTRACT

A play yard assembly with positioning and securing features for lift off devices is provided. A top rail of a main frame of the play yard assembly has a coupling portion with a crushed cross section where a first engaging piece with alignment feature is provided thereto. The lift off device has a second engaging piece utilized for aligning with the first engaging piece, so at to install the lift off device at the designated location along the top rail.

7 Claims, 5 Drawing Sheets

PLAY YARD ASSEMBLY

CROSS REFERENCE TO RELATED APPLICATIONS

This application claims the benefits of U.S. Provisional Application No. 62/176,892, which was filed on Mar. 16, 2015 and is incorporated herein by reference.

BACKGROUND OF THE INVENTION

1. Field of the Invention

The invention relates to a child apparatus, and more particularly, to a play yard assembly with positioning and securing features for lift off devices.

2. Description of the Prior Art

Play yard top rail lift off devices, such as nappers or diaper changers, require location features that can properly align the lift off devices on the play yard and securely install the lift off devices thereunto. If the location features are not present or the location features can be easily bypassed, the lift off devices can be installed incorrectly on the top rail of the play yard, leading to unstable positioning.

SUMMARY OF THE INVENTION

To solve the above mentioned problems, the invention provides a play yard assembly with positioning and securing features for lift off devices.

According to an embodiment of the invention, a play yard assembly includes a main frame, a first engaging piece, and a lift off device. The main frame has a top rail having a coupling portion with a first cross section and the rest portion of the top rail other than the coupling portion comes with a second cross section. The dimension of the first cross section along a radial direction of the top rail is smaller than the dimension of the second cross section along the radial direction. The first engaging piece is mounted to the top rail and aligns with the coupling portion. The lift off device is detachably installed at the coupling portion of the top rail and the lift off device includes a second engaging piece. When the lift off device is installed at the coupling portion, the first engaging piece is coupled to the second engaging piece and the lift off device is locked at the coupling portion.

According to the embodiment of the invention, the first cross section of the coupling portion is in a crushed form for at least a segment of its contour.

According to the embodiment of the invention, the second engaging piece includes an engaging body and a latch. The engaging body has a chamber with the dimension along the radial direction no smaller than the first cross section and smaller than the second cross section. The latch is movably disposed at the engaging body and is selectively configurable to a locking position or a release position with respect to the engaging body.

According to the embodiment of the invention, the first engaging piece includes an abutting end. When the lift off device is installed at the coupling portion, the first engaging piece is accommodated in the chamber where the abutting end is abutted by the latch configured at the locking position.

According to the embodiment of the invention, the latch includes a button and a hook and the latch is rotatably disposed at the engaging body. When the button is pressed, the latch is rotated with respect to the engaging body to the release position and the hook moves out of the chamber. When the button is not pressed, the latch is rotated with respect to the engaging body to the locking position and the hook moves into the chamber and abuts against the abutting end of the first engaging piece.

According to the embodiment of the invention, the top rail is formed by round pipes and the second cross section has circular contour.

According to the embodiment of the invention, the lift off device is a napper, a diaper changer, a bouncer, a bassinet, or a rocker.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. In the following discussion and in the claims, the terms "include" and "comprise" are used in an open-ended fashion. Also, the term "couple" is intended to mean either an indirect or direct mechanical connection. Thus, if a first device is coupled to a second device, that connection may be through a direct mechanical connection, or through an indirect mechanical connection via other devices and connections.

Figure 1:
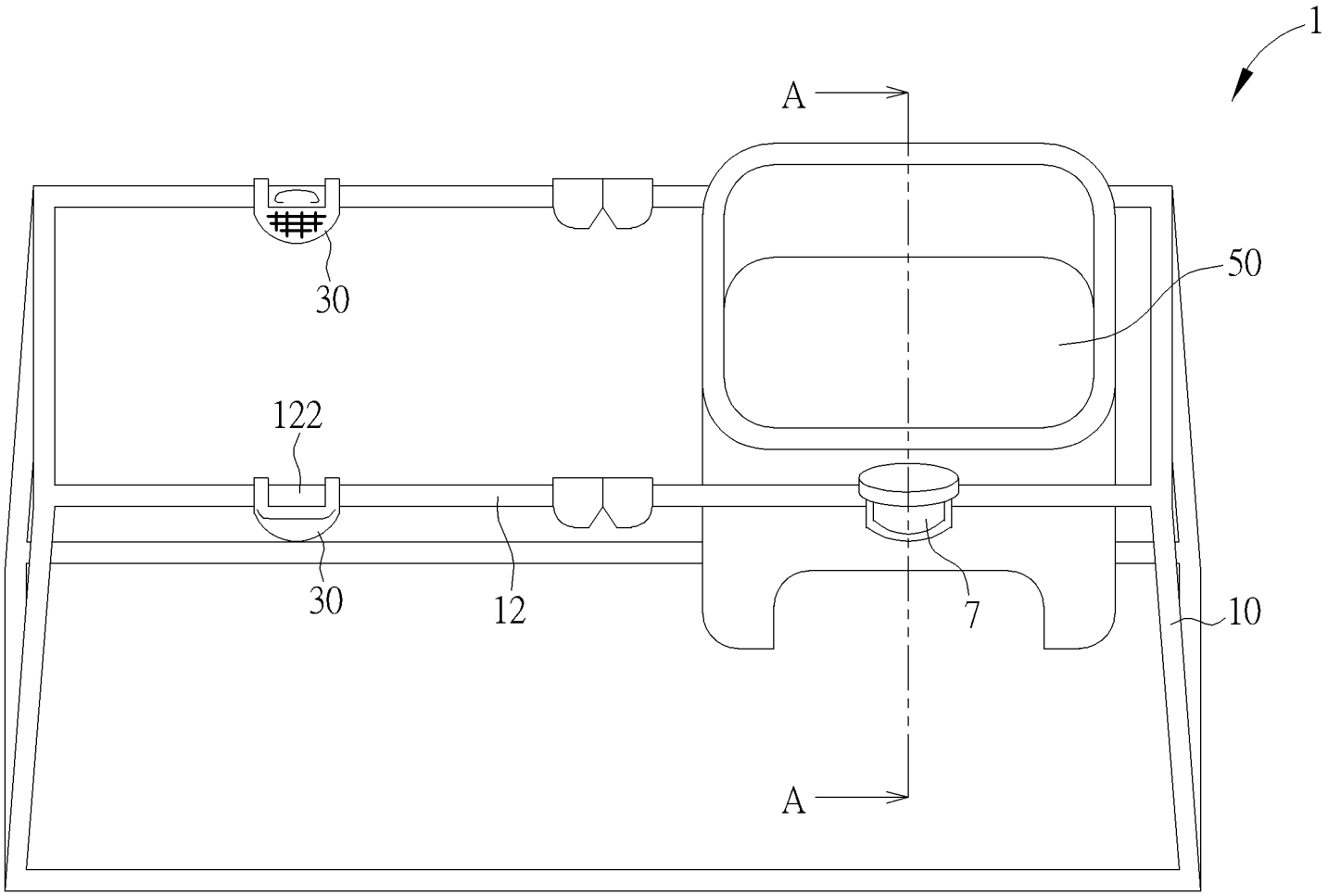
FIG. 1 is an illustration showing a partial view of a play yard assembly according to the invention.
Figure 2:
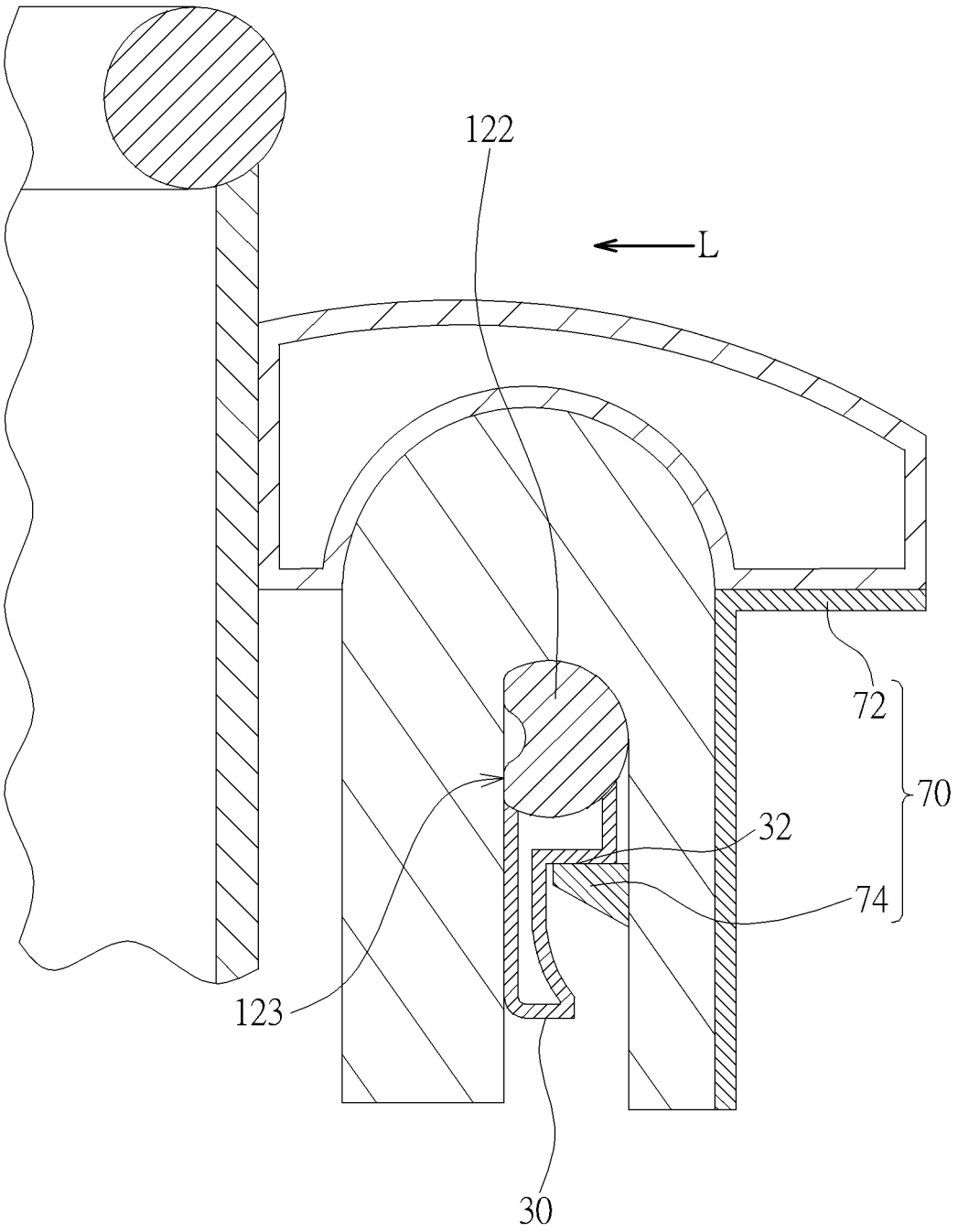
FIG. 2 is an illustration showing a cross sectional view of line A-A in FIG. 1.

Please refer to FIG. 1 and FIG. 2. FIG. 1 is an illustration showing a partial view of a play yard assembly according to the invention and FIG. 2 is an illustration showing a cross sectional view of line A-A in FIG. 1. A play yard assembly 1 includes a main frame 10, a first engaging piece 30, and a lift off device 50. FIG. 1 shows only some parts of the main frame 10, where other necessary components for the main frame 10 such as the enclosure, the mattress, and the base are not illustrated in the figure. The main frame 10 has a top rail 12, which in the embodiment is formed by round pipes. The top rail 12 has at least one coupling portion 122 for installation of the lift off device 50.

Figure 3:
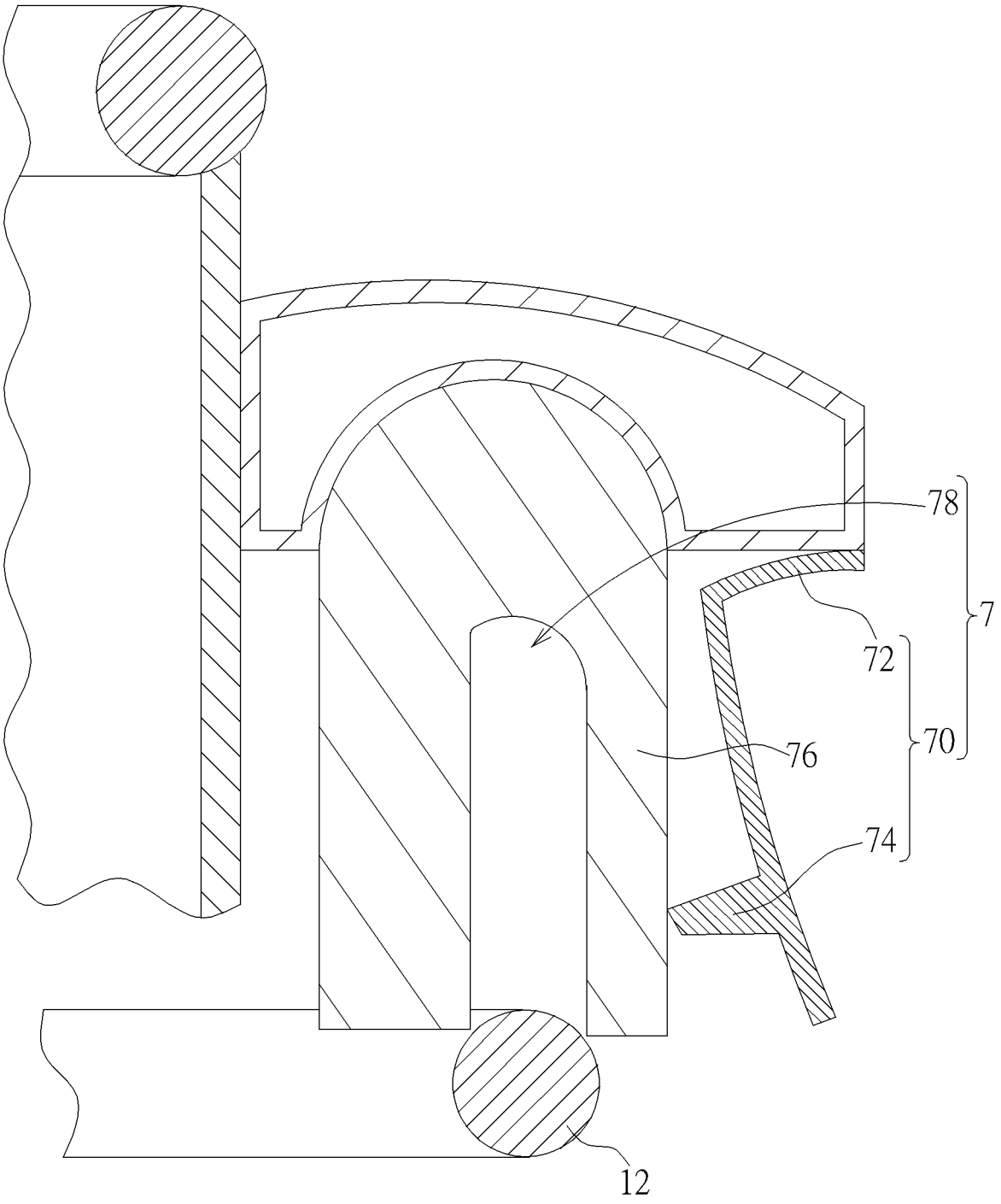
FIG. 3 is an illustration showing a cross sectional view of the lift off device and a portion of the top rail.

Please refer to FIG.1, FIG.2 and also refer to FIG.3, which is an illustration showing a cross sectional view of the lift off device and a portion (not the coupling portion 122) of the top rail. In the embodiment, the coupling portion 122 of the top rail 12 comes with a first cross section and the rest portion of the top rail 12 other than the coupling portion 122, as shown in FIG.3, comes with a second cross section having circular contour. To be more specific, some portions of the top rail 12 can be crushed so that at least a segment of the cross section of the top rail 12 may be made flat (and indented) compared to the rest round arc segment. A (or more than one) crushed portion 123 exists as the coupling portion 122 where the dimension of the first cross section along a radial direction L of the top rail 12 is smaller than the dimension of the second cross section (of the original round pipe form) along the radial direction L.

The first engaging piece 30 with aligning feature is provided to be mounted to the top rail 12 at the location of the coupling portion 122, or in other words, the first engaging piece 30 aligns with the coupling portion 122, as shown in FIG. 1. In a preferred embodiment, when fabric is wrapped around the main frame 10 (and the top rail 12) as an integral part of the play yard assembly 1, an opening on the fabric is provided at the location that aligns with where the first engaging piece 30 is mounted on the top rail 12, so that the first engaging piece 30 can fit through the fabric for sufficient exposure of the first engaging piece 30 on the fabric.

Figure 4:
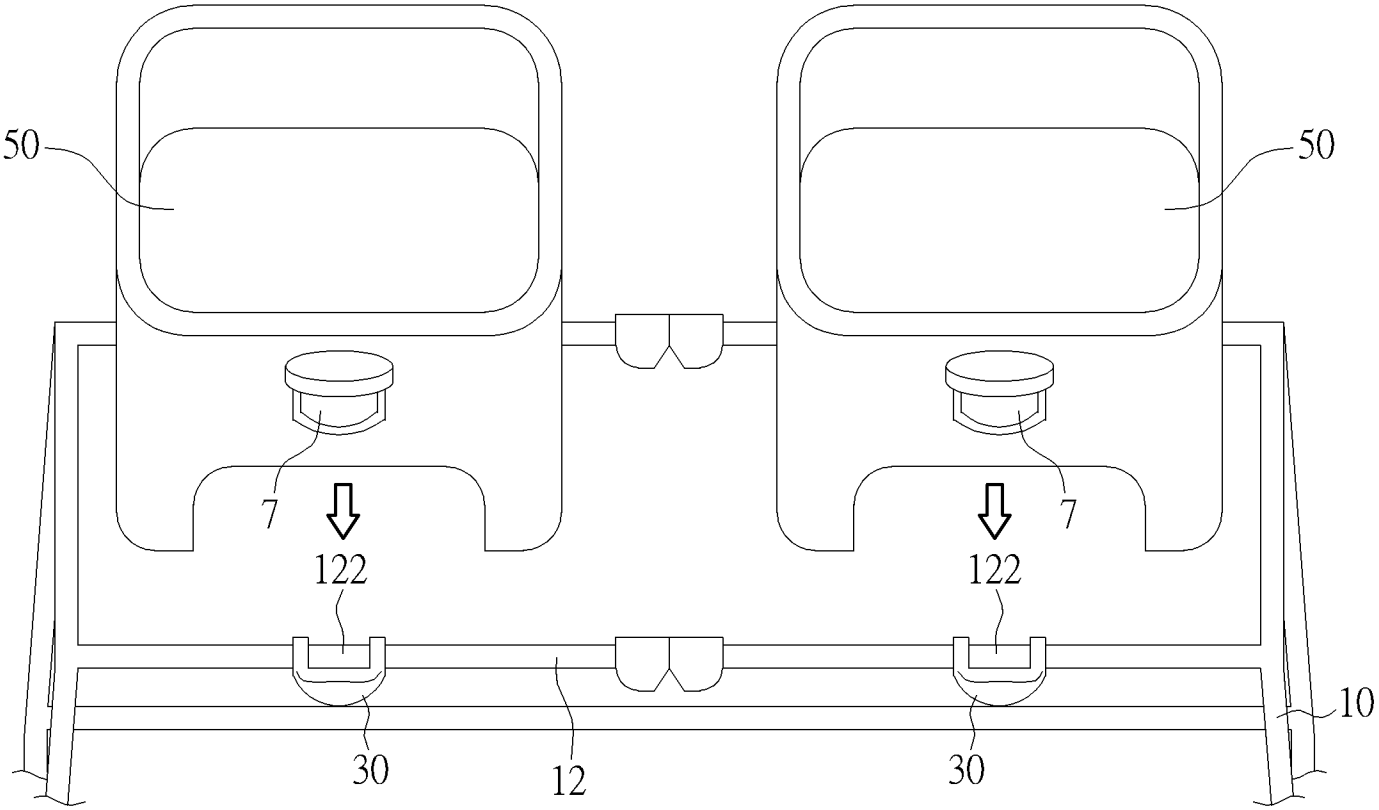
FIG. 4 is an illustration showing lift off devices to be installed to the top rail.

Please refer to FIG. 4, which is an illustration showing lift off devices to be installed to the top rail. The lift off device 50, either a napper, a diaper changer, or infant accessory platform such as a bouncer, a bassinet, or a rocker that can be incorporated into the play yard assembly 1, may be detachably installed at the coupling portion 122 of the top rail 12. For the main frame 10 with its top rail 12 having more than one coupling portion 122 and first engaging piece 30, say two sets of coupling portion 122/first engaging piece 30 are provided in the embodiment in FIG. 4, either one or two lift off devices 50 may be installed on the main frame 10 as shown in FIG. 4.

Figure 5:
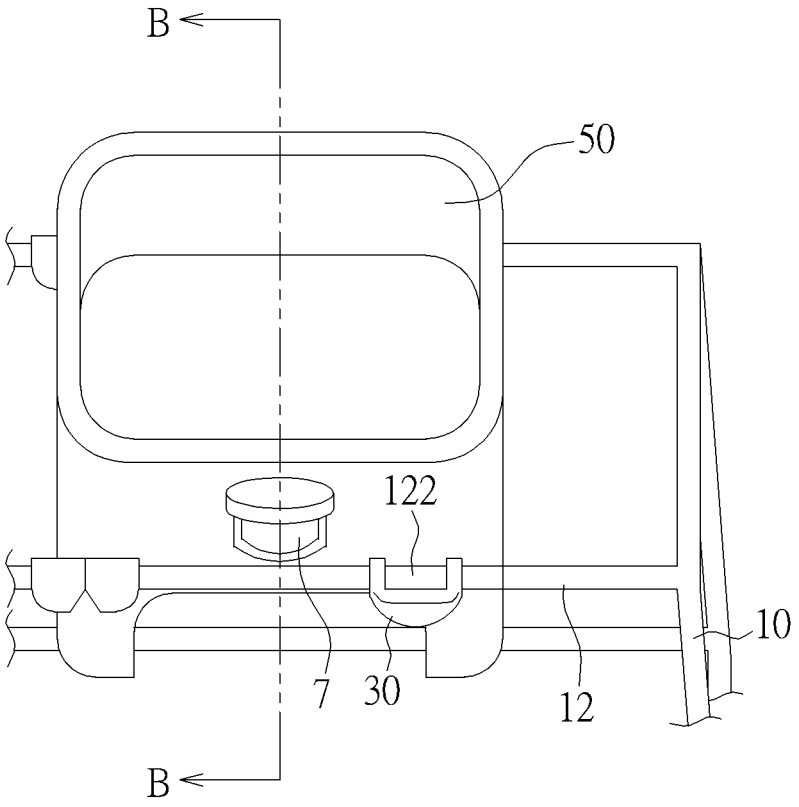
FIG. 5 shows an illustration of a misplacement of the lift off device with respect to the top rail.

Refer to FIG.2 and FIG.3. The lift off device 50 includes a second engaging piece 7 for coupling with the first engaging piece 30 and the coupling portion 122 when the lift off device 50 is installed at the coupling portion 122. In this embodiment, the second engaging piece 7 includes an engaging body 76 having a chamber 78 with the dimension along the radial direction no smaller than the first cross section and smaller than the second cross section. With the dimension features, the lift off device 50 is allowed to be installed at the coupling portion 122 (a designated attachment position) with the coupling portion 122 able to reach into the chamber 78, while the specific dimension feature of the chamber 78 withstands a user forcing the lift off device 50 over the top rail 12 when the second engaging piece 7 is placed in a non-designated attachment area, or the rest portion of the top rail 12 other than the crushed coupling portion 122 since there is no crushed feature of the portion. FIG.5 shows an illustration of a misplacement of the lift off device 50 with respect to the top rail 12, and FIG.3 is the cross sectional view of line B-B in FIG.5. Please also note that the dimension configuration between the second engaging piece 7 and the non designated attachment position of the rest portion of the top rail 12 that has the second cross section also visually displays clear misuse of the lift off device 50 when the lift off device 50 is not correctly placed at the coupling portion 122. In some cases, the arc shape of the bottom of the second engaging piece 7, referring to FIG.5, allows the lift off device 50 to rotate about the contact area on the top rail 12, when the lift off device 50 is placed on the top rail 12 at the portion with the second cross section. The tilting of the lift off device 50 is convenient to show misuse of the lift off device 50.

Refer to FIG.2 and FIG.3. The second engaging piece 7 also includes a latch 70, and in this embodiment, the latch 70 includes a button 72 and a hook 74, and is movably disposed at the engaging body 76 to be configured to a locking position as shown in FIG.2 or to a release position as shown in FIG.3 with respect to the engaging body 76. To be more specific, the latch 70 is rotatably disposed at the engaging body 76. The hook 74 may be selectively moved into or out of the chamber 78. If the lift off device 50 is to be installed at the coupling portion 122, the second engaging piece 7 is centered over the location of the coupling portion 122, where the coupling portion 122 moves into the chamber 78 and pushes the hook 74 out of the chamber 78 (to the release position as in FIG.3) until the coupling portion 122 and the first engaging piece 30 are fully accommodated in the chamber 78. The first engaging piece 30 has an abutting end 32 for being abutted by the hook 74 of the latch 70 being restored to the locking position as in FIG.2 (when the button 72 is not pressed), so that the first engaging piece 30 is coupled to the second engaging piece 7 and the lift off device 50 is locked at the coupling portion 122.

When the button 72 is pressed (upward), the latch 70 rotates to the release position as shown in FIG. 3 and the hook 74 moves out of the chamber 78, the abutting end 32 of the first engaging piece 30 is no longer restrained by the latch 70 and the second engaging piece 7 and the lift off device 50 are removable from the top rail 12.

The play yard assembly provided in the invention have the ability to provide exact positioning for the lift up devices to locate themselves on the top rail without the concern of incorrect placement. User attempting to bypass the locating features when installing the lift up devices on the top rail will be prevented. The first engaging piece with alignment feature provided in the invention can also visually notify users when the lift off devices are incorrectly positioned on the top rail before it is engaged into the engaging piece.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A play yard assembly, comprising:

a main frame having a top rail, the top rail having a coupling portion with a first cross section and a rest portion of the top rail other than the coupling portion comprising a second cross section, wherein a dimension of the first cross section along a radial direction of the top rail is smaller than a dimension of the second cross section along the radial direction;

a first engaging piece mounted to the top rail and aligning with the first cross section; and a lift off device detachably installed at the coupling portion of the top rail, the lift off device comprising a second engaging piece;

wherein when the lift off device is installed at the coupling portion, the first engaging piece is coupled to the second engaging piece and the lift off device is locked at the coupling portion;

wherein the second engaging piece comprises an engaging body having a chamber with a dimension along the radial direction no smaller than the first cross section and smaller than the second cross section.

2. The play yard assembly of claim 1, wherein the first cross section is in a crushed form for at least a segment of its contour.

3. The play yard assembly of claim 1, wherein the second engaging piece comprises:

a latch, movably disposed at the engaging body, the latch selectively configurable to a locking position or a release position with respect to the engaging body.

4. The play yard assembly of claim 3, wherein the first engaging piece comprises an abutting end, when the lift off device is installed at the coupling portion, the first engaging piece is accommodated in the chamber where the abutting end is abutted by the latch configured at the locking position.

5. The play yard assembly of claim 4, wherein the latch comprises a button and a hook and the latch is rotatably disposed at the engaging body;

wherein when the button is pressed, the latch is rotated with respect to the engaging body to the release position and the hook moves out of the chamber;

wherein when the button is not pressed, the latch is rotated with respect to the engaging body to the locking position and the hook moves into the chamber and abuts against the abutting end of the first engaging piece.

6. The play yard assembly of claim 1, wherein the top rail is formed by round pipes and the second cross section has a circular contour.

7. The play yard assembly of claim 1, wherein the lift off device is a napper, a diaper changer, a bouncer, a bassinet, or a rocker.

* * * * *